US008961271B2

(12) United States Patent
Roden

(10) Patent No.: US 8,961,271 B2
(45) Date of Patent: Feb. 24, 2015

(54) ABRASIVE BLASTING APPARATUS FOR REMOTELY ACTIVATING AND MODULATING FLOW OF ABRASIVE BLASTING MATERIAL

(75) Inventor: John Russell Roden, Bel Air, MD (US)

(73) Assignee: Reco Atlantic, LLC, Baltimore, MD (US)

( * ) Notice: Subject to any disclaimer, the term of this patent is extended or adjusted under 35 U.S.C. 154(b) by 230 days.

(21) Appl. No.: 13/605,649

(22) Filed: Sep. 6, 2012

(65) Prior Publication Data

US 2013/0157546 A1 Jun. 20, 2013

Related U.S. Application Data

(60) Provisional application No. 61/531,364, filed on Sep. 6, 2011.

(51) Int. Cl.
*B24C 1/04* (2006.01)
*B24C 7/00* (2006.01)

(52) U.S. Cl.
CPC ..... *B24C 7/00* (2013.01); *B24C 7/0046* (2013.01)
USPC ..... 451/101; 451/2; 451/5; 451/39; 451/40; 451/90

(58) Field of Classification Search
CPC ..... B24C 1/045; B24C 3/322; B24C 7/0046; B24C 3/062
USPC ..... 451/2, 5, 39, 40, 90, 91, 92, 101; 251/121, 63, 63.5, 297
See application file for complete search history.

(56) References Cited

U.S. PATENT DOCUMENTS

| | | | | | |
|---|---|---|---|---|---|
| 3,070,924 | A | * | 1/1963 | Hastrup | 451/90 |
| 3,543,444 | A | * | 12/1970 | Mehta | 451/2 |
| 3,638,839 | A | * | 2/1972 | Weightman | 406/85 |
| 3,858,358 | A | | 1/1975 | Stachowiak et al. | |
| 4,075,789 | A | | 2/1978 | Dremann | |
| 5,024,029 | A | | 6/1991 | Abbott et al. | |
| 5,083,402 | A | * | 1/1992 | Kirschner et al. | 451/38 |
| 5,097,633 | A | | 3/1992 | Branton et al. | |
| 5,207,034 | A | * | 5/1993 | Lynn | 451/88 |
| 5,216,848 | A | * | 6/1993 | Abbott et al. | 451/2 |
| 5,407,379 | A | | 4/1995 | Shank et al. | |
| 5,412,910 | A | * | 5/1995 | Woodson et al. | 451/38 |
| 5,421,767 | A | * | 6/1995 | Spears, Jr. et al. | 451/101 |
| 5,542,873 | A | * | 8/1996 | Shank, Jr. | 451/75 |
| 5,556,325 | A | * | 9/1996 | Shank, Jr. | 451/101 |
| 5,591,064 | A | * | 1/1997 | Spears, Jr. | 451/2 |
| 5,613,895 | A | | 3/1997 | Baker | |
| 5,810,045 | A | * | 9/1998 | Evans | 137/312 |
| 5,934,971 | A | * | 8/1999 | Thompson et al. | 451/2 |

(Continued)

*Primary Examiner* — George Nguyen
(74) *Attorney, Agent, or Firm* — Berenato & White, LLC

(57) ABSTRACT

An abrasive blasting apparatus comprises a blast pot, a blast media valve fluidly connected to said blast media outlet of the blast pot, a source of pressurized gas, a proportional air valve in fluid communication with the blast media valve and the source of pressurized air, a hose having a blast nozzle at a distal end thereof, and a main control unit fluidly connected to the blast media valve and the air valve. The blast media valve comprises a housing having a blasting media intake, a plunger disposed within the housing, a sleeve disposed between the housing and the plunger, a blast media port in the sleeve, a casing fixedly connected to the housing, a piston disposed within the casing and connected to the plunger, and a base member fixedly connected to the housing. The plunger is movable by the piston with respect to the blast media port.

18 Claims, 8 Drawing Sheets

(56) References Cited

U.S. PATENT DOCUMENTS

| | | | | |
|---|---|---|---|---|
| 6,607,175 | B1 * | 8/2003 | Nguyen et al. | 251/63.5 |
| 6,827,637 | B2 * | 12/2004 | Lewin et al. | 451/75 |
| 7,524,233 | B1 * | 4/2009 | Reilley | 451/38 |
| 8,057,279 | B2 | 11/2011 | Connelly | |
| 8,535,113 | B2 * | 9/2013 | Weidert | 451/2 |
| 2002/0173220 | A1 * | 11/2002 | Lewin et al. | 451/2 |
| 2010/0115932 | A1 * | 5/2010 | Kassel et al. | 60/299 |
| 2014/0093434 | A1 * | 4/2014 | Kassel et al. | 422/168 |

* cited by examiner

ABRASIVE BLASTING APPARATUS FOR REMOTELY ACTIVATING AND MODULATING FLOW OF ABRASIVE BLASTING MATERIAL

CROSS-REFERENCE TO RELATED APPLICATION

This Application claims the benefit under 35 U.S.C. 119(e) of U.S. Provisional Patent Application Ser. No. 61/531,364 filed Sep. 6, 2011 by Roden, J. R., which is hereby incorporated herein by reference in its entirety and to which priority is claimed.

FIELD OF THE INVENTION

This present invention relates to abrasive blasting systems in general and, more particularly, to a controlled abrasive blasting apparatus with remote abrasive media blast controls and improved pneumatically actuated media valve for remotely activating and modulating the flow of abrasive media from an abrasive media holding tank.

BACKGROUND OF THE INVENTION

Cleaning large metal surfaces with abrasive blasting material (abrasive grit material) by abrasive blasting (or pressure blasting such as by sandblasting, bead blasting, etc., is well known in the related art. The most commonly used type of abrasive blasting media currently used is silica sand, fine glass beads, steel shot, steel grit, stainless steel shot, cut wire, grit or similar sized pellets, etc. It is possible to repeatedly use the same abrasive blasting material (or media) several times, if the abrasive blasting material is properly cleaned between each use.

During blasting operations using prior art abrasive blasting equipment, the operator directs a mixture of pressurized air and the abrasive blasting media through a nozzle to the area requiring cleaning or blasting. The abrasive blasting media is stored in a blast pot (or abrasive media holding tank) containing the abrasive media that is pressurized with air. The nozzle is typically connected to the blast pot through a length of flexible hose so that the nozzle may be used at various distances that are remote from the blast pot.

Prior art blasting equipment utilizes an on/off control so that the blast stream can be stopped or started with no variation in the amount of particulate flow or pressure from the blast pot. In order to regulate the flow of particulate, the operator must stop the blasting operation and return to the blast pot so that the flow setting of the blast pot can be manually adjusted. The operator must then return to the blast nozzle, test the particulate flow from the nozzle and determine whether the particulate flow is adequate or optimal. If the flow is not optimal, the operator must return to the blast pot and continue this process until the proper particulate flow is achieved. As can be seen, this is an inconvenient and time consuming process. Furthermore, during a job, different degrees of particulate flow may be required or necessary at any given time to perform the blasting operation. In some instances, the particulate flow may be optimal for certain areas, but too low or too high for others. In many instances, proper optimization may not be seriously pursued by the operator because of the inconvenience of adjusting the abrasive flow. This may result in abrasive being wasted because it is either insufficient or excessive for the part color area being blasted or it provides an inadequate blasting job. Accordingly, what is therefore needed is a means for abrasive blasting wherein the amount of blasting media can be controlled remotely from the blast pot and during the blasting operation to overcome these shortcomings.

SUMMARY OF THE INVENTION

The present invention provides an abrasive blasting apparatus with remote abrasive media blast controls and improved pneumatically actuated media valve for remotely activating and modulating the flow of abrasive media from an abrasive media holding blast pot.

The abrasive blasting apparatus comprises a blast pot storing abrasive blasting media and having a blast media outlet, a pneumatically actuated abrasive blast media valve fluidly connected to the blast media outlet of the blast pot, a source of pressurized gas fluidly connected to the abrasive blast media valve, a proportional air valve in fluid communication with the blast media valve and the source of pressurized air upstream of the blast media valve, a hose having a blast nozzle at a distal end thereof, and a main control unit fluidly connected to the blast media valve and the proportional air valve. The blast media valve comprises a housing having a blasting media intake fluidly connected to the blast pot and a blasting media exit, a plunger disposed within the housing, a sleeve disposed within the housing between the housing and the plunger, a blast media port in the sleeve and provided to receive a blast media, a casing fixedly connected to the housing, a piston disposed within the casing and connected to the plunger, and a base member fixedly connected to the housing. The base member is in fluid communication with the blast media port. The plunger is movable by the piston with respect to the blast media port between a fully closed position to a fully open position. The proportional air valve providing variable gas pressure to the abrasive blast media valve. The hose fluidly connecting the blast media valve to the blast nozzle located downstream of the blast media valve. The blast media valve is provided to control the passage of the blasting material through the nozzle.

Other aspects of the invention, including apparatus, systems, methods, and the like which constitute part of the invention, will become more apparent upon reading the following detailed description of the exemplary embodiments and viewing the drawings.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS AND EXEMPLARY METHODS

Figure 1:
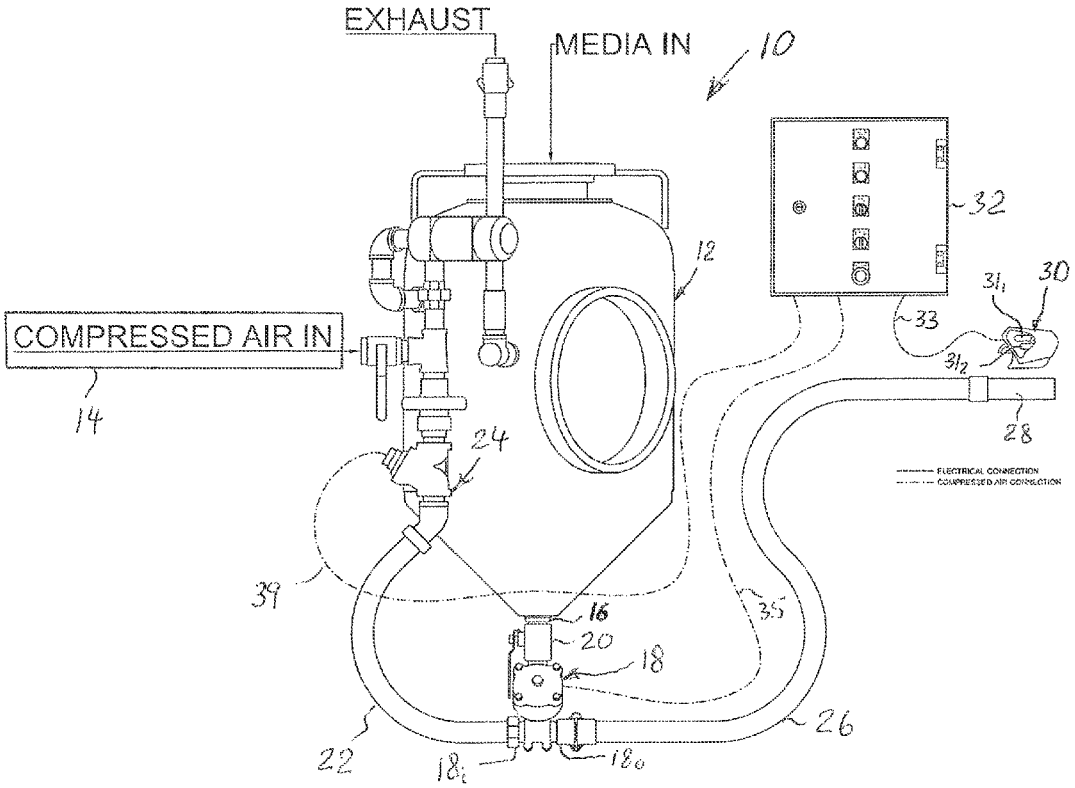
FIG. 1 is a schematic view of an abrasive blasting apparatus according to an exemplary embodiment of the invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are no intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

FIG. 1 of the drawings illustrates an abrasive blasting apparatus according to an exemplary embodiment of the present invention indicated generally by reference numeral 10. The apparatus 10 includes a blast pot (holding tank) 12 partially filled with abrasive blasting material (or blast media, or grit) under pneumatic pressure. The abrasive blast media may be silica sand, fine glass beads, steel shot, steel grit, stainless steel shot, cut wire, grit or similar sized pellets, or any of the many other agents used in the blasting industry to remove materials, such as paint, rust, slag, and other materials, from a surface. The blast media is put into the blast pot 12 through an opening that is then sealed airtight by hatch, after which the blast pot 12 is pressurized by compressed gas.

The apparatus 10 further includes a source of pressurized gas 14, such as a compressor, for providing a pressurized gas. The pressurized (or compressed) gas is typically air, although other gases, such as nitrogen, carbon dioxide, etc., or mixture of gases, may also be used with the apparatus 10. The compressor 14 may be electrically powered from an outside power source or powered by a combustible fuel engine, such as diesel or gasoline.

A tower end of the blast pot 12 has a blast media outlet 16 fluidly connected to a blast media valve 18 through an abrasive media discharge tine 20. The blast media valve 18 is fluidly connected to the source of pressurized gas 14 through a high-pressure conduit 22 and a spring-loaded, variable pressure air control valve 24 located upstream of the blast media valve 18. In other words, as illustrated in FIG. 1, the air control valve 24 is in fluid communication with the source of pressurized gas 14, on one side, and the blast media valve 18 through the high-pressure conduit 22 on the other side of the air control valve 24. The spring-loaded, variable pressure air control valve 24 is of a conventional design known in the art, such as, for example, 420 Series by AQUAMATIC, INC., or Auto Air Valve NC. 2" NPT (Product Code FP03505000) BY EROL EXPORTS PVT, LTD. the air control valve 24 is provided to selectively regulate (adjust) the pressure of the compressed air supplied to the blast media valve 18.

A length of flexible hose 26 is fluidly coupled to the blast media valve 18. The flexible 26 may have a variety of different lengths depending upon the blasting application, but is typically from about 5 ft. (about 1.5 meters) to about 200 ft. (about 61 meters) or more. As further illustrated in FIG. 1, a blast nozzle 28, from which a high-pressure stream of compressed air or air/grit mixture comes out, is coupled to a distal end of the flexible hose 26. The flexible hose 26 is configured for providing a particulate blast spray, such as those that are known to those skilled in the art. In other words, as illustrated in FIG. 1, blast media valve 18 is in fluid communication with the air control valve 24 through the high-pressure conduit 22 attached to an inlet port 18*i* of the blast media valve 18, and the blast nozzle 28 through the flexible hose 26 attached to an exhaust port 18*e* of the blast media valve 18. Thus, the blast media valve 18 is provided to control the passage of the abrasive blast media through the blast nozzle 28. Moreover, a deadman controller 30 is mounted to or otherwise provided with the blast nozzle 28 so that it is in an accessible proximity to the operator when handling the blast nozzle 28. In the exemplary embodiment of the present invention, the deadman controller 30 is attached to the blast nozzle 28.

The deadman controller 30 includes a pair of toggle switches $\mathbf{31}_1$ and $\mathbf{31}_2$ is provided with the deadman controller 30. Although the toggle switches $\mathbf{31}_1$ and $\mathbf{31}_2$ are shown in a side by side arrangement, a second controller or controller housing for each toggle switch $\mathbf{31}_1$ and $\mathbf{31}_2$ may provided as well. The controllers or controller housings may be staggered along the length of the blast nozzle 28 or hose 26, one behind the other, to facilitate the use of both hands to control the switches $\mathbf{31}_1$ and $\mathbf{31}_2$ while handling the blast nozzle 28. The toggle switches $\mathbf{31}_1$ and $\mathbf{31}_2$ are for controlling the main control unit 32. Electrical wiring or signal cable 33 for the toggles $\mathbf{31}_1$ and $\mathbf{31}_2$ leads from the blast nozzle 28 to the main control unit 32. The toggle $\mathbf{31}_1$ a two-wire switch where the toggle $\mathbf{31}_2$ merely performs a cutoff or on/off function. The toggle $\mathbf{31}_1$ is biased so that release of the toggle $\mathbf{31}_1$ brings it to a centered or neutral position upon release. The toggle $\mathbf{31}_2$ for the blast media valve 18 may be a three-wire switch wherein operating the toggle $\mathbf{31}_2$ reverses current flow and configured to regulate the blast media valve 18 to regulate the compressed air supplied from the compressor 14 and thus adjust the air/grit ratio of the material exiting through the blast nozzle 28.

The abrasive blasting apparatus according to the exemplary embodiment of the present invention further comprises a main control unit 32 provided in selectively control the operation of the blast media valve 18 and the air control valve 24. The main control unit 32 is located remote from the blast nozzle 28 (such as at the blast pot 12) for remotely controlling and adjusting abrasive blasting. According to the exemplary embodiment of the invention, an operator is able to adjust the abrasive blast media at the blast pot 12 remotely from blast nozzle controls (the deadman controller 30) or from any other remote location. The main control unit 32 controls air pressure and air/grit ratio of the material emerging from the blast nozzle 28 by controlling the air control valve 24 and the blast media valve 18.

Figure 2:
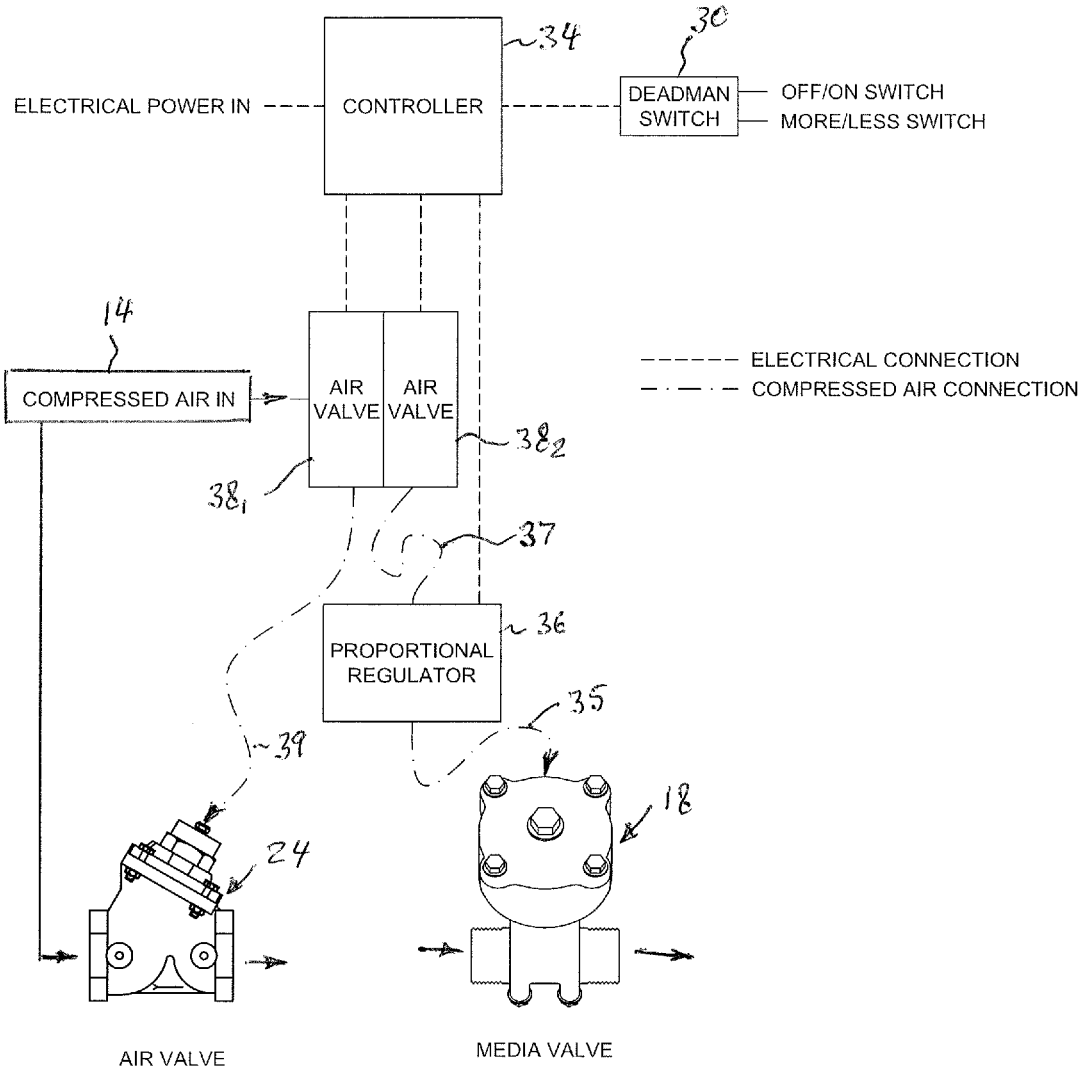
FIG. 2 is a control diagram of the abrasive blasting apparatus of FIG. 1.
Figure 4:
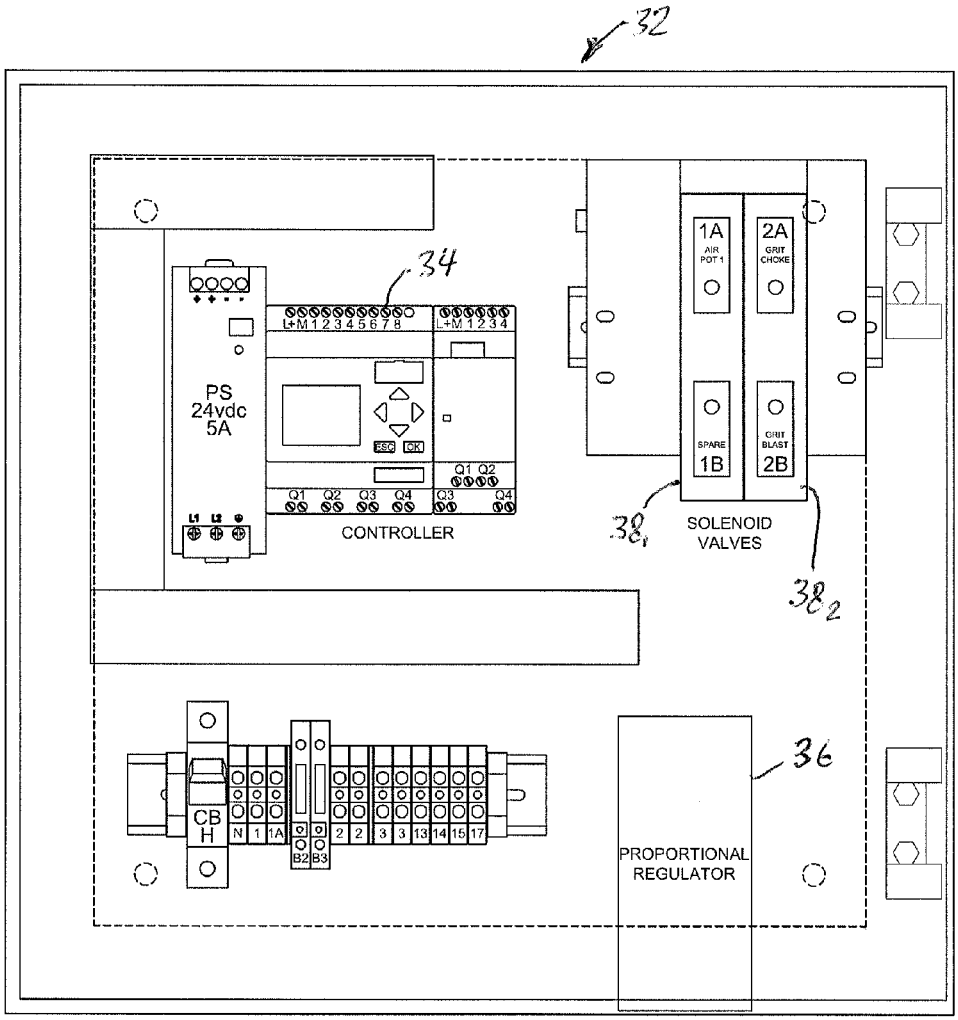
FIG. 4 is a front view of a interior panel layout of the main control unit of the abrasive blasting apparatus according to the exemplary embodiment of the invention.
Figure 5:
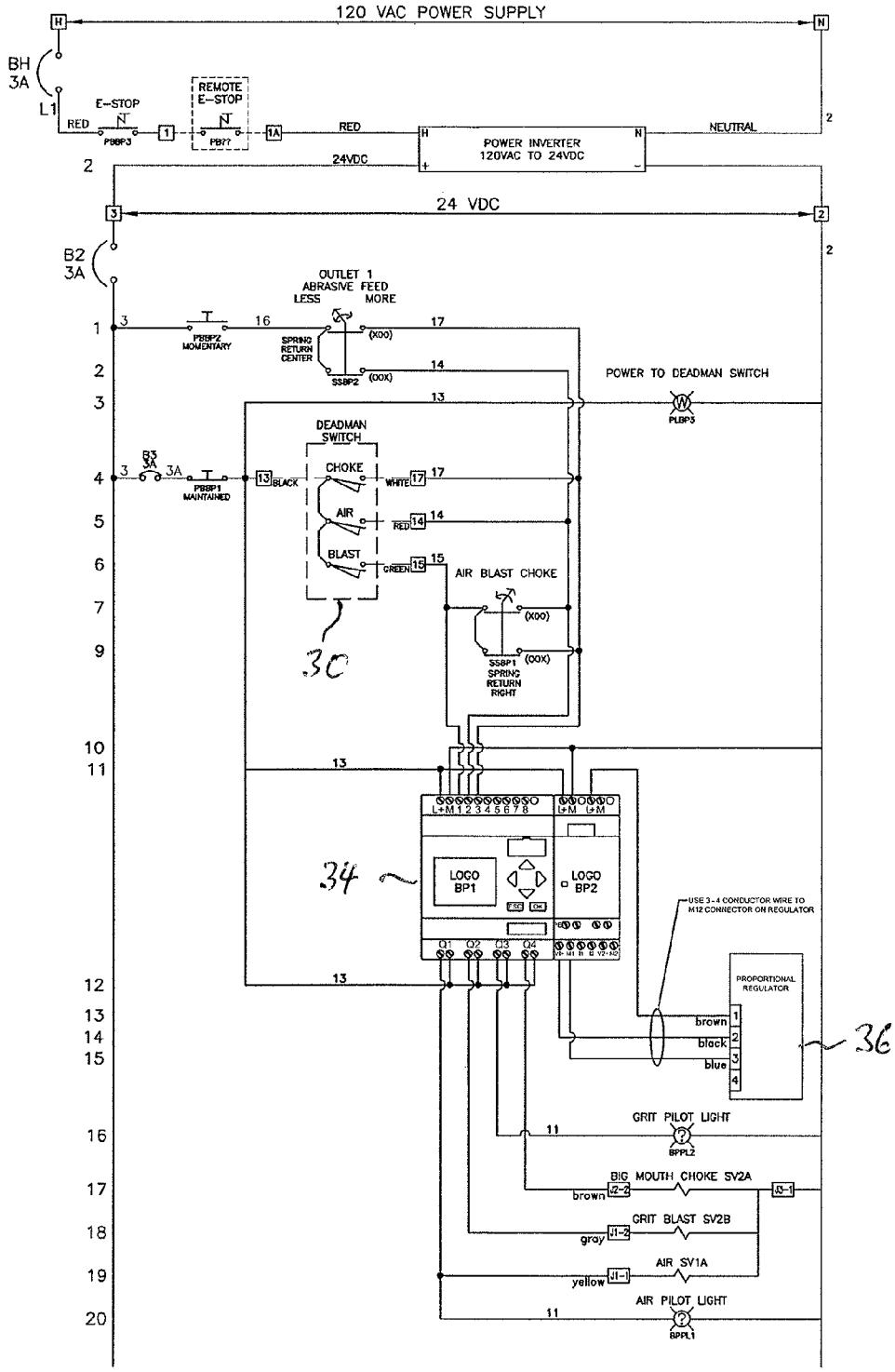
FIG. 5 is a block diagram of an electrical circuit of the main control unit of the abrasive blasting apparatus according to the exemplary embodiment of the invention.

As illustrated in FIGS. 2, 4 and 5, the main control unit 32 comprises an electronic controller 34 including an electronic control unit (ECU), a proportional regulator 36 and two solenoid air valves $\mathbf{38}_1$ and $\mathbf{38}_2$. It should be understood that the number of solenoid valves less or more than two is within the scope of the present invention. The electronic controller 34 is of a conventional design known in the art, such as LOGO! From Siemens Energy & Automation, Inc.

The proportional regulator 36 is also of a conventional design known in the art, such as P31P/P32P Series or PAR™-15 Series by Parker Hannifin Corp. As illustrated in detail in FIG. 2, the proportional regulator 36 is controlled by the controller 34, and is fluidly connected to both the blast media valve 18 via tubing 35 and the solenoid air valve 387 via tubing 37. Specifically, as illustrated in FIG. 2, the proportional regulator 36 is located downstream of the solenoid air valve $\mathbf{38}_2$ and upstream of the blast media valve 18. The proportional regulator 36 is provided to control the gas pressure to an operator of the blast media valve to adjust the feed rate of the blast media.

According to the exemplary embodiment of the present invention, the solenoid air valves $\mathbf{38}_1$ and $\mathbf{38}_2$ are identical and of a conventional design known in the art, such as VS26 Series by NORGREN®. Both the solenoid air valves $\mathbf{38}_1$ and $\mathbf{38}_2$ are connected to the source of pressurized gas 14 and are controlled by the controller 34. The first solenoid air valve $\mathbf{38}_1$ is provided to selectively supply the pressurized air to the air control valve 24 via tubing 39 (i.e., the first solenoid air valve $\mathbf{38}_1$ is located upstream of the air control valve 24), while the second solenoid air valve $\mathbf{38}_2$ is provided to selectively supply the pressurized air to the proportional regulator 36 via tubing 37 (i.e., located upstream of the proportional regulator 36).

Figure 3:
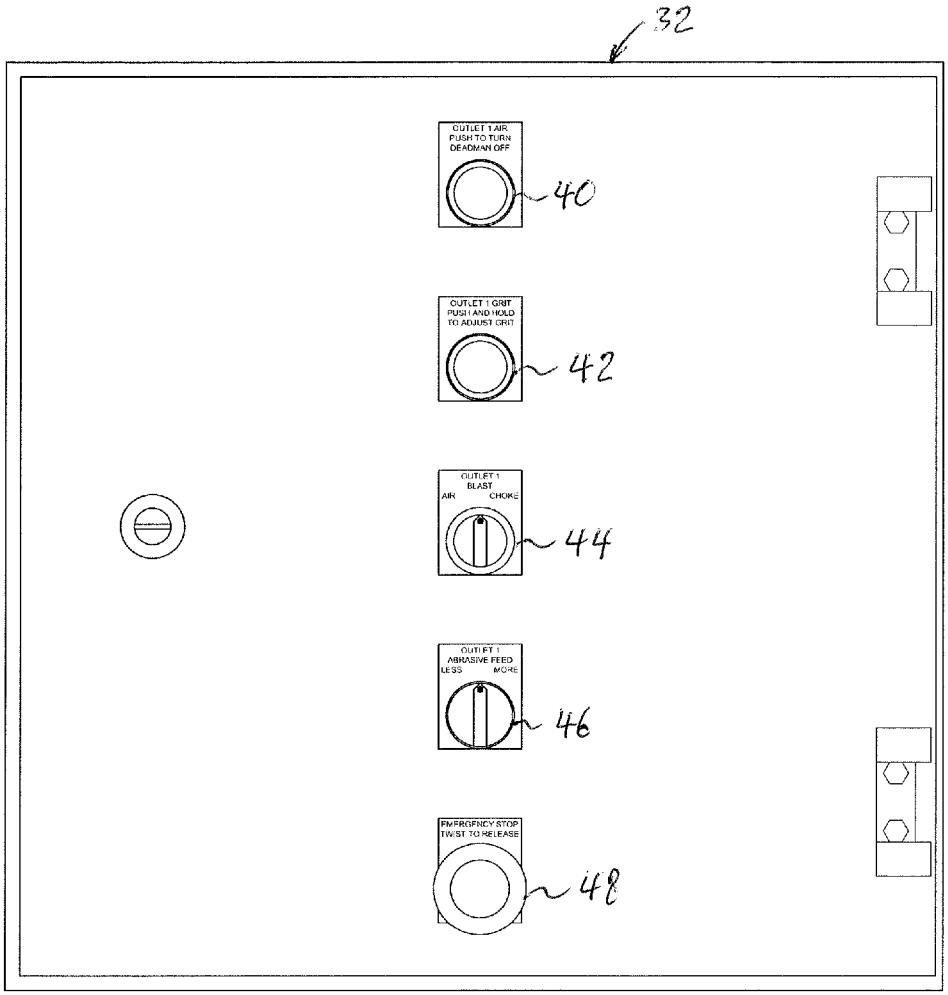
FIG. 3 is a front view of a front panel layout of a main control unit of the abrasive blasting apparatus according to the exemplary embodiment of the invention.

As illustrated in FIG. 3, a front panel layout of the main control unit 32 includes a "Deadman Off" switch 40 so that the operator can selectively deactivate the deadman controller 30, a grit adjustment switch 42, a blast switch 44 for selecting "Air" or Choke" mode, an abrasive blast media feed rate switch 46 for selectively controlling the rate of feed of the abrasive blast media, and an emergency stop button 48.

A choke position of blast switch 44 is actuated by the operator when he wants to have the air control valve 24 closed so that the only pressure on the blast media in the pot 12 will be from the top, thereby forcing out any chimp of blast media clogging the port into the blast nozzle 28. An air-only position of the blast switch 44 is provided to close the blast media valve 18 and allow only the stream of compressed air to pass through the blast nozzle 28 to clean loose material off of a surface to be cleaned.

Figure 6:
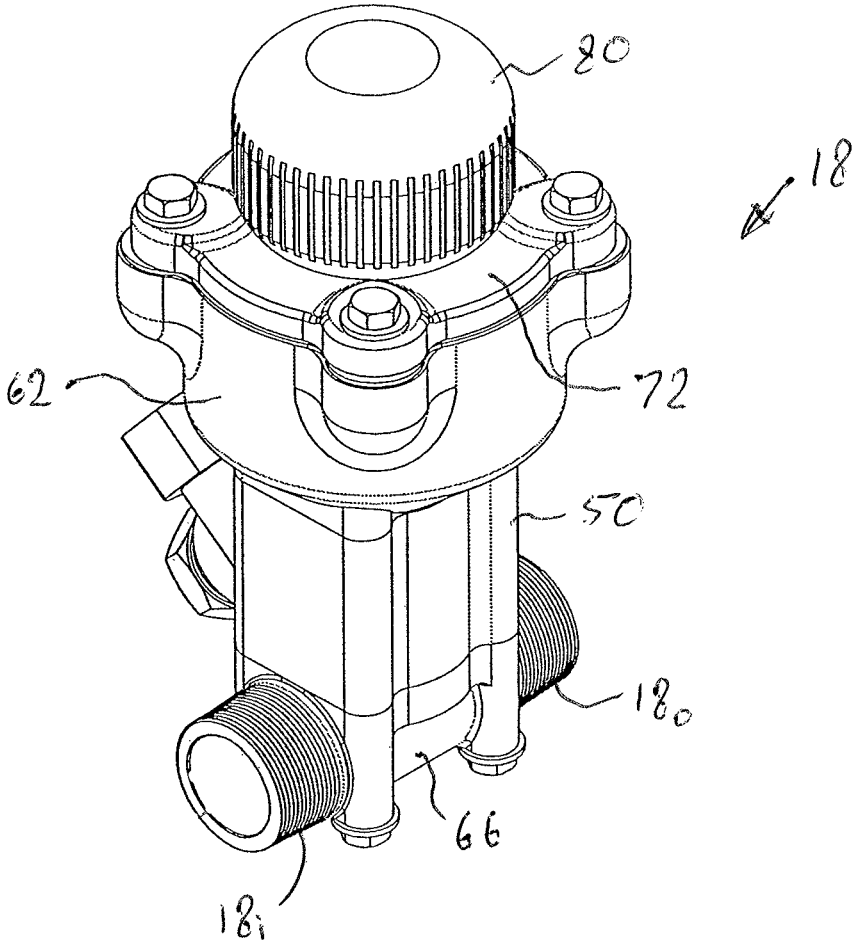
FIG. 6 is a perspective view of a abrasive blasting media valve of the abrasive blasting apparatus according to the exemplary embodiment of the invention.
Figure 7:
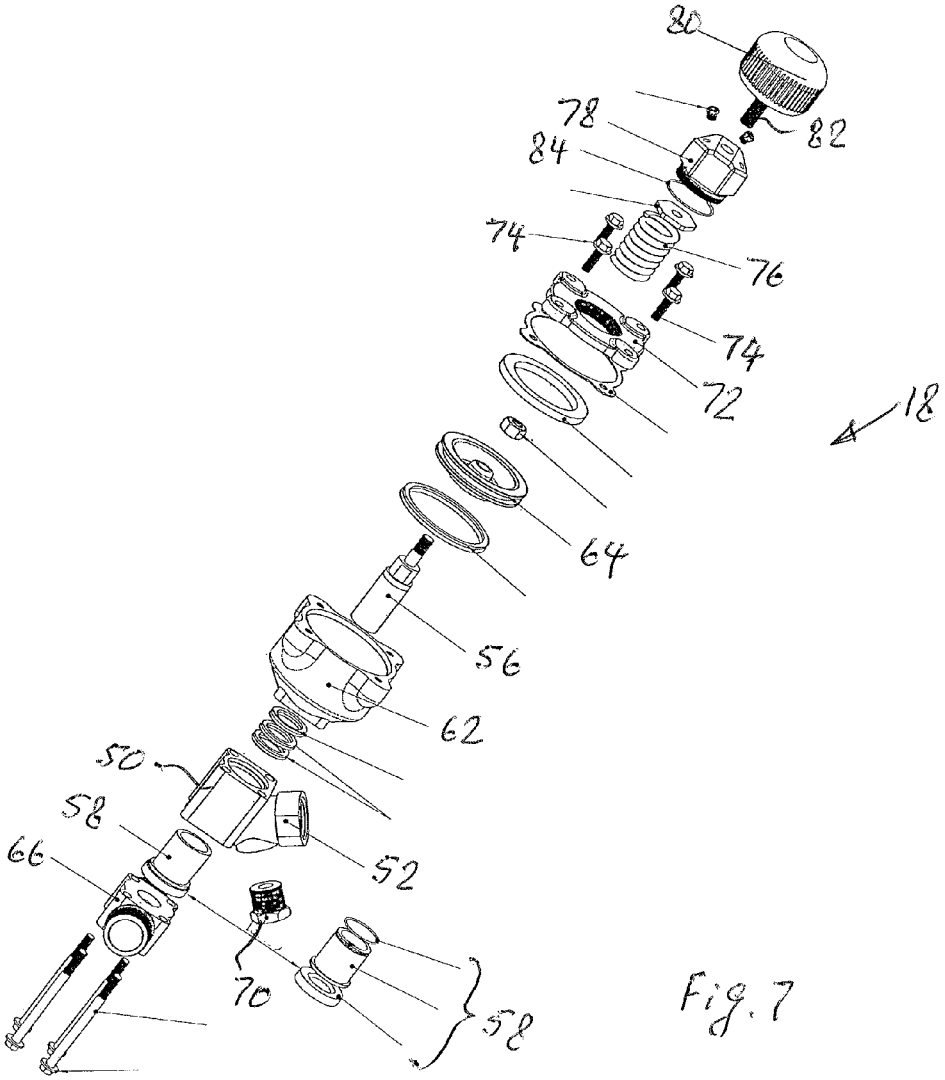
FIG. 7 is an exploded perspective view of the abrasive blasting media valve of FIG. 4.
Figure 8:
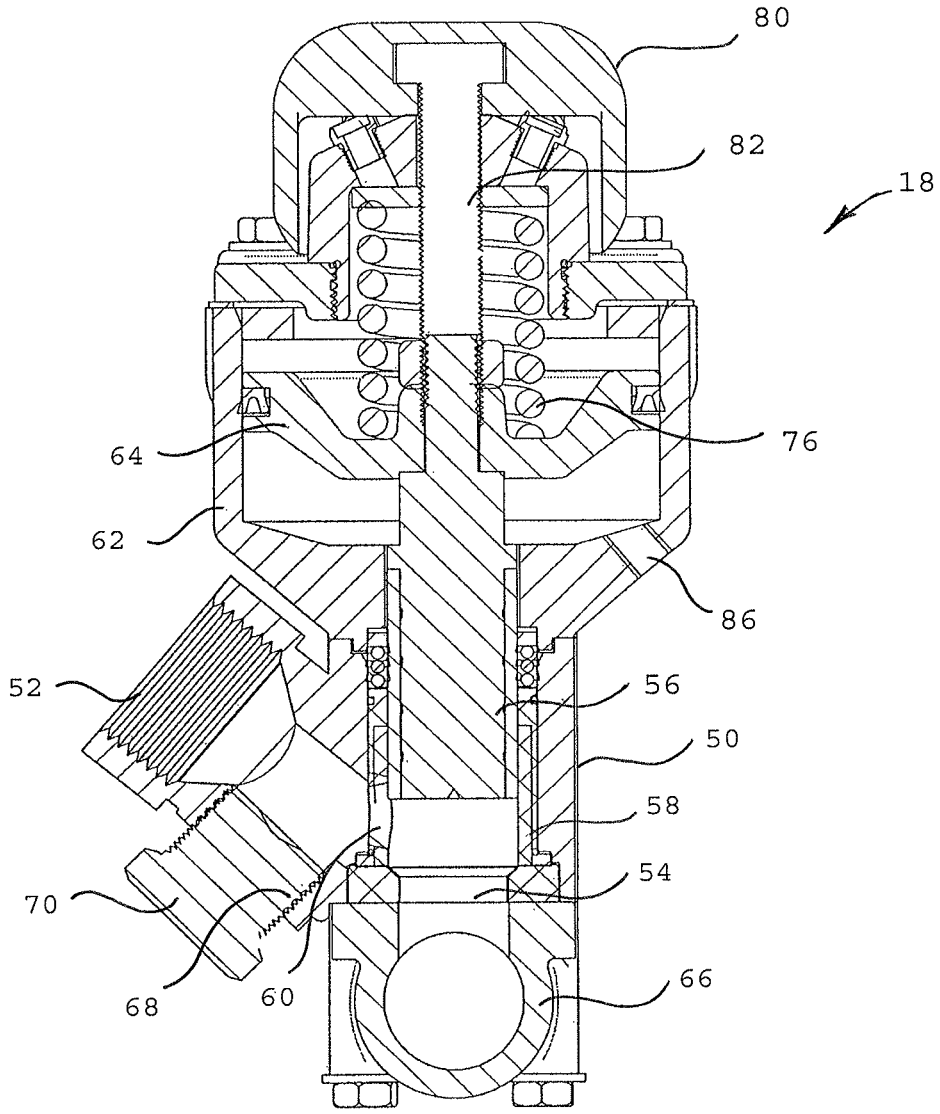
FIG. 8 is a vertical cross-sectional view of the abrasive blasting media valve of FIG. 4.

The blast media valve 18, illustrated in detail in FIGS. 6-8, comprises a housing 50 having a blast media intake 52 and a blast media exit 54. Within the housing 50 is disposed a plunger 56 and a sleeve 58 positioned between the housing 50 and the plunger 56. The sleeve 58 is provided with oblast media port 60 that allows the blast media to pass from the blast media intake 52 to the blast media exit 54 when the plunger 56 is not blocking the blast media port 60. The plunger 56 is moveable in a range of positions to block off more or less of the blast media port 60. In other words, the plunger 56 is moveable with respect to the blast media port 60 between a fully closed position to a fully open position.

The blast media valve 18 further includes a casing 62 fixedly connected to housing 50. A piston 64 is connected to the plunger 56 and disposed within the casing 62. A base member 66 is fixedly connected to the housing 50 such that the base member 66 fluidly communicates with the blast media exit 54 of the housing 50. The housing 50 includes a bypass or cleanout opening 68 communicating directly with blast media port 52. Typically during operation of blast media valve 18, the cleanout opening 68 is closed by a plug 70.

The casing 62 includes a cap 72, which may be removed to provide access to the inside of the casing 62. The cap 72 covers an open top of the casing 62. Preferably, order to insure a secure connection, four evenly spaced bolt holes and bolts 74 are used to secure the cap 72 to the casing 62.

The casing 62 includes structure to allow the adjustment of the operation of the blast media valve 18. Specifically, the casing 62 encloses a spring 76 and attendant structure to adjust the tension on the spring 76 and, thus, the operation of the blast media valve 18. The spring 76 rests between the piston 64 and the cap 72, biasing the piston 64 and plunger 56 toward the blast media exit 54 and thus biasing the blast media valve 18 into a closed position. The tension on the spring 76 may be used to control the resistance to move the piston 64, and thus, the amount of pressure required to actuate the blast media valve 18 or the degree of actuation for a given pressure. To adjust the tension on the spring 76, a spring retainer 78 is used that mates with the cap 72 of the casing 62. In order to allow the tension on the spring 76 to be adjusted, a device for facilitating the adjustment of the spring retainer 78, such as a knob 80, is used. An O-ring 84, or like seal, may be positioned between the spring retainer 78 and the casing 62, to prevent the ingress of contaminants into the casing 62. The blast media valve 18 further include a stroke adjustment rod 82 fixedly connected to the knob 80. By rotating the knob 80, the stroke adjustment rod 82 is movable relative to the casing 62. Thus, by changing position of the stroke adjustment rod 82 (by rotating the knob 80), the length of the stroke of the plunger 56 can be adjusted. As illustrated best in FIG. 8, the casing 62 further includes a regulator hole 86 therethrough to which the tubing 35 is connected.

In operation, the blast media is fed through the blast media intake 52 to the housing 50 of the blast media 18, which regulates the flow of the blast media to the blast nozzle 28. As the compressed air flows through the base member 66 and passes across the blast media exit 54, the blast media port 60 is automatically opened by displacement of the plunger 56. This result in a pressurized flow of the abrasive media downwardly through the housing 50 and the base member 66, through the blast media exit 54 and dispensed into the pressurized air stream flowing through the flexible hose 26 and the blast nozzle 28. The pressure within the flexible hose 26 acts to force the abrasive outwardly to the blast nozzle 28.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. An abrasive blasting apparatus comprising:

a blast pot storing abrasive blasting media and having a blast media outlet;

a pneumatically actuated abrasive blast media valve fluidly connected to said blast media outlet of said blast pot;

a source of pressurized gas fluidly connected to said abrasive blast media valve;

a proportional air valve in fluid communication with said blast media valve and said source of pressurized air upstream of said blast media valve, said proportional air valve providing variable gas pressure to said abrasive blast media valve;

a hose having a blast nozzle at a distal end thereof, said hose fluidly connecting said blast media valve to said blast nozzle located downstream of said blast media valve, said blast media valve controlling the passage of the abrasive blasting media through said blast nozzle;

a main control unit fluidly connected to said blast media vuivv and said proportional air valve, said main control unit comprising an electronic controller including an electronic control unit;

said blast media valve comprising:

a housing having a blast media intake fluidly connected to said blast pot and a blast media exit;

a plunger disposed within said housing;

a sleeve disposed within said housing between said housing and said plunger;

a blast media port in said sleeve and provided to receive the abrasive blast media;

a casing fixedly connected to said housing;

a piston disposed within said casing and connected to said plunger; and a base member fixedly connected to said housing, said base member being in fluid communication with said blast media port; and said plunger being movable by said piston with respect to said blast media port between a fully closed position to a fully open position.

2. The abrasive blasting apparatus as defined in claim 1, wherein said main control unit further comprises a first solenoid valve electrically connected to said electronic controller and fluidly connected to said proportional air valve; and wherein said first solenoid valve is fluidly connected to said source of pressurized gas and is controlled by said electronic controller.

3. The abrasive blasting apparatus as defined in claim 2, wherein said first solenoid valve is configured to selectively supply pressurized air to said proportional air valve.

4. The abrasive blasting apparatus as defined in claim 2, wherein said main control unit further comprises a proportional regulator and a second solenoid valve; and wherein said proportional regulator is controlled by said electronic controller and is fluidly connected to both said blast media valve and said second solenoid valve.

5. The abrasive blasting apparatus as defined in claim 4, wherein said first solenoid valve is configured to selectively supply pressurized air to said proportional regulator.

6. The abrasive blasting apparatus as defined in claim 4, wherein said first and second solenoid valves are identical.

7. The abrasive blasting apparatus as defined in claim 1, further comprising a deadman controller mounted to said blast nozzle so that said deadman controller is in an accessible proximity to an operator when handling said blast nozzle.

8. The abrasive blasting apparatus as defined in claim 7, wherein said deadman controller includes a pair of toggle switches controlling said main control unit.

9. The abrasive blasting apparatus as defined in claim 8, wherein said pair of toggle switches includes a cutoff switch.

10. The abrasive blasting apparatus as defined in claim 9, wherein said pair of toggle switches includes a switch configured to regulate said blast media valve to regulate the compressed air supplied from said source of pressurized gas so as to adjust an air/grit ratio of material exiting through said blast nozzle.

11. The abrasive blasting apparatus as defined in claim 7, wherein said main control unit includes a "Deadman Off" switch configured to selectively deactivate said deadman controller.

12. The abrasive blasting apparatus as defined in claim 1, wherein said main control unit includes a grit adjustment switch.

13. The abrasive blasting apparatus as defined in claim 1, wherein said main control unit includes a blast switch for selecting "Air" or Choke" mode.

14. The abrasive blasting apparatus as defined in claim 1, wherein said main control unit includes an abrasive blast media feed rate switch for selectively controlling a rate of feed of the abrasive blast media.

15. The abrasive blasting apparatus as defined in claim 1, wherein said main control unit includes an emergency stop button.

16. The abrasive blasting apparatus as defined in claim 1, wherein said blast media valve further comprises a spring enclosed in said casing for biasing said piston and said plunger toward said fully closed position.

17. The abrasive blasting apparatus as defined in claim 16, wherein said blast media valve further comprises a knob configured to adjust the tension on said spring.

18. The abrasive blasting apparatus as defined in claim 17, wherein said blast media valve further comprises a stroke adjustment rod fixedly connected to said knob such that rotation of said knob 80 displaces said stroke adjustment rod relative to said casing.

* * * * *